United States Patent [19]

Ogihara et al.

[11] 4,298,972

[45] Nov. 3, 1981

[54] ALARM SIGNALING TIME DETECTING DEVICE FOR LEAF TYPE DIGITAL CLOCK

[75] Inventors: Masuo Ogihara; Kozo Chimura; Nobuo Shinozaki; Yoichi Seki, all of Yotsukaido, Japan

[73] Assignee: Seiko Koki Kabushiki Kaisha, Tokyo, Japan

[21] Appl. No.: 107,553

[22] Filed: Dec. 27, 1979

[30] Foreign Application Priority Data

Dec. 28, 1978 [JP] Japan ..... 53-163742

[51] Int. Cl.[3] ..... G04B 19/02; G04C 21/16

[52] U.S. Cl. ..... 368/222; 368/254

[58] Field of Search ..... 368/72, 73, 74, 78, 368/222, 243, 250, 254, 235

[56] References Cited

U.S. PATENT DOCUMENTS 3,922,843 12/1975 Kobayashi ..... 368/74

4,005,570 2/1977 Miyamoto et al. ..... 368/72

4,045,627 3/1977 Kitai et al. ..... 368/250

4,122,659 10/1978 Hashimoto ..... 368/78

*Primary Examiner*—Vit W. Miska

*Attorney, Agent, or Firm*—Robert E. Burns; Emmanuel J. Lobato; Bruce L. Adams

[57] ABSTRACT

A first detecting means for detecting the phase of an hour time wheel and a second detecting means adapted to cooperate with a projection provided with each of some of a plurality of minute indication leaves, said some leaves occurring at a constant interval, are provided. The first and second detecting means are associated together, and with detection of phase by the first detecting means the second detecting means is rendered capable of cooperation with the projection of a minute leaf. Subsequently, when the phase of the projection is detected by the second detecting means, an alarm device is operated.

3 Claims, 6 Drawing Figures

ALARM SIGNALING TIME DETECTING DEVICE FOR LEAF TYPE DIGITAL CLOCK

BACKGROUND OF THE INVENTION

This invention relates to an alarm signaling time detecting device for a leaf type digital clock and, more particularly, to improvements in and relating to such a detecting device, in which the final detection of the alarm signaling time is made with a minute leaf, for improving the accuracy of the alarm signaling time. Regarding the persuit of the accuracy of the alarm signaling time in the leaf type digital clock, the alarm device may be actuated without error with respect to the preset alarm signaling time by effecting the last detection of the alarm signaling time in synchronism to the invertion of the minute leaf.

This principle has already been proposed by the instant applicant in Japanese Patent Application No. 107528/1977 and corresponding U.S. Pat. application Ser. No. 935,763 filed Aug. 22, 1978. Briefly, the principle is realized by providing some of a plurality of minute leaves occurring at a constant interval of minutes with a projection, which cooperates with a last detection means. With this construction, however, the last detection means is always cooperating with a minute leaf, so that this means does not only constitute a load for a driving motor but also the durability is inferior since the means is always in frictional contact with a minute leaf.

SUMMARY OF THE INVENTION

An object of the invention is to eliminate the above drawback.

According to the invention, the above object is achieved by permitting the leaf detection means and minute leaf to be separated from each other with the movement of the detection member caused when an hour hand wheel comes to coincidence with the detection member.

DETAILED DESCRIPTION OF THE INVENTION

Figure 1:
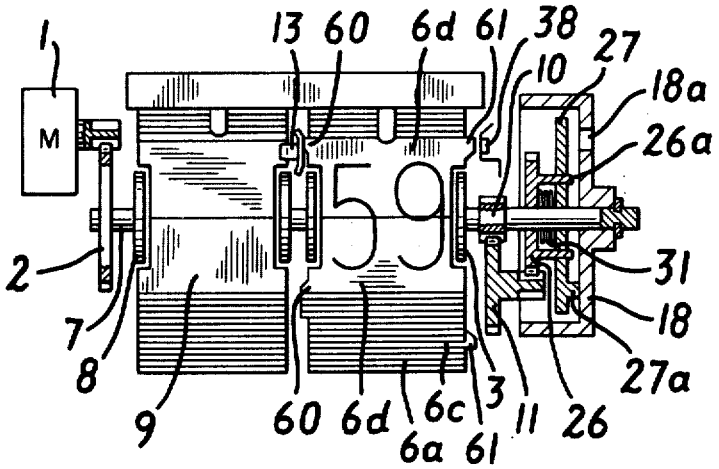
FIG. 1 is a plan view of a first embodiment of the invention.

Now, description of the embodiments illustrated in the drawings will be made. First, the construction of a first embodiment shown in FIGS. 1 to 4 will be described.

Designated at 1 is a driving motor which drives a minute hand wheel 2 secured to a rotative shaft 7. Designated at 3 is a minute leaf drum, which is secured to the shaft 7 and has a plurality of minute leaves to be described later. Designated at 8 is an hour leaf drum, which has a plurality of hour leaves 9 and is rotatably mounted on the shaft and driven at a constant speed from the minute hand wheel 2 through a well-known gear train (not shown). The afore-mentioned minute leaves include first minute leaves 6*a* having no projection, second minute leaves 6*b* each provided at the left hand edge with a projection 60, third minute leaves 6*c* each provided at the right hand edge with a projection 61 and fourth minute leaves 6*d* each provided at both the left and right hand edges with respective projections 60 and 61.

The projections 60 of the second and fourth minute leaves 6*b* and 6*d* cooperate with an hour leaf holding spring 13 for synchronizing the inversion of a fourth minute leaf 6*d* and an hour leaf 9 at the time when the minute leaf is inverted from the state indicating "59" minutes past a given hour to the state indicating "00" minute.

The third minute leaves 6*c* are provided each for every 10 leaves of all the leaves. Designated at 38 is a detecting contact piece which is adapted to cooperate with the projections 61 of the third and fourth minute leaves 6*c* and 6*d*.

Designated at 10 is a minute hand pinion secured to the shaft 7 and meshing with a second intermediate hour wheel, which is rotatable about the shaft 7 and meshing with a second hour hand wheel 26. The second hour hand wheel 26 has two pins 26*a*, which can guide a detection member 27 only in the axial direction.

The detection member 27 is provided on the right side with a cam 27*a*. Designated at 18 is an alarm signaling time setting wheel, which is rotatable about the shaft 7 and adapted to rotate with a click stop action for every 10 minutes in cooperation with a well-known means (not shown). The alarm signaling time setting wheel 18 has a hole 18*a*. When the alarm signaling time is reached, the hole 18*a* comes into coincidence or in phase with the cam 27*a* of the detection member 27, whereupon the detection member 27 is moved rightwards by the force of a spring 31.

Figure 2:
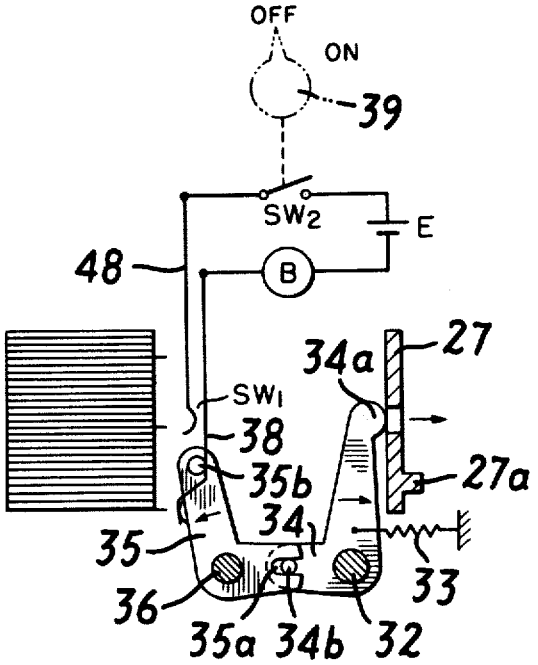
FIG. 2 is a plan view of the upper portion of the device shown in the FIG. 1.

Now, the description will be continued with reference to FIG. 2. Designated at 38 is a detecting contact piece which can cooperate with the projection of the third and fourth minute leaves 6*c* and 6*d*. The detecting contact piece 38 together with a stationary contact piece 48 comprises a detecting switch $SW_1$.

A first detecting lever 34 is rotatable about a shaft 32 and spring biased in the clockwise direction by a spring 33, and its tip 34*a* is always in contact with the detection member 27. It is also provided at the other end with a pin 34*b* which will be described later.

A second detecting lever 35 is rotatable about a shaft 36, and is provided adjacent to one end with a groove 35*a*, in which the afore-mentioned pin 34*b* is engaged, and at the other end with a pin 35*b* cooperative with the afore-mentioned detecting contact piece 38. Until the rightward movement of the detection member 27 is caused by the spring 31, the detecting contact piece 28 is held spaced apart a predetermined gap from the projection 61 of the minute leaves.

An alarm stopping button 39 cooperates with a manual switch $SW_2$. A buzzer B has one end connected to the negative terminal of a power supply E and the other end connected through the detecting switch $SW_1$ and manual switch $SW_2$ to the positive terminal of the power supply E.

The operation of the above structure will now be described.

The manual switch $SW_2$ is first closed by the user by turning the alarm stopping button 39 in the closing direction.

Then, a desired alarm signaling time is set by turning the alarm signaling time setting wheel 18. At this time, the cam 27*a* of the detection member 27 is not driven into the hole 18*a* of the alarm signaling time setting wheel yet, so that the detecting switch $SW_1$ is in the open state.

When the clock is set in this state, when the alarm signaling time is approached with the leaf drums 3 and 8 driven by the motor 1, the detection member 27 is pushed by the first detecting lever 34 and moved thereby rightwards, thus causing clockwise rotation of the first detecting lever 34 and counterclockwise rotation of the second detecting lever 35. At this time, the detecting contact piece 38 is caused to follow the pin 35*b* and move toward the minute leaves 6 to a position ready for cooperation with a minute leaf 6.

In other words, the detecting contact piece 38 will not be brought into contact with a minute leaf until a close proximity of the alarm signaling time is reached. At this time, the detecting contact piece 38 is adapted to be in engagement with the projection 61 of the third or fourth minute leaf 6*c* or 6*d*, so that the detecting switch $SW_1$ is not closed yet. Thus, the buzzer B is not operated yet.

When the time is further elapsed until the minute leaf 6*c* or 6*d* is eventually inverted, the engagement between the detecting contact piece 38 and projection 61 is released to close the detecting switch $SW_1$, thus causing the buzzer B to sound. The buzzer B is repeatedly on-off operated according to the on and off operation of the detecting switch $SW_1$ until the detection member 27 is moved leftwards when the cam 27*a* of the detection member 27 moves out of phase with the hole 18*a* with the rotation of the detection member 27.

If it is desired to stop the operation of the buzzer B during this time, the manual switch $SW_2$ may be opened by the user by turning the alarm stopping button 39 in the opening direction, whereby the buzzer will be stopped.

Figure 3:
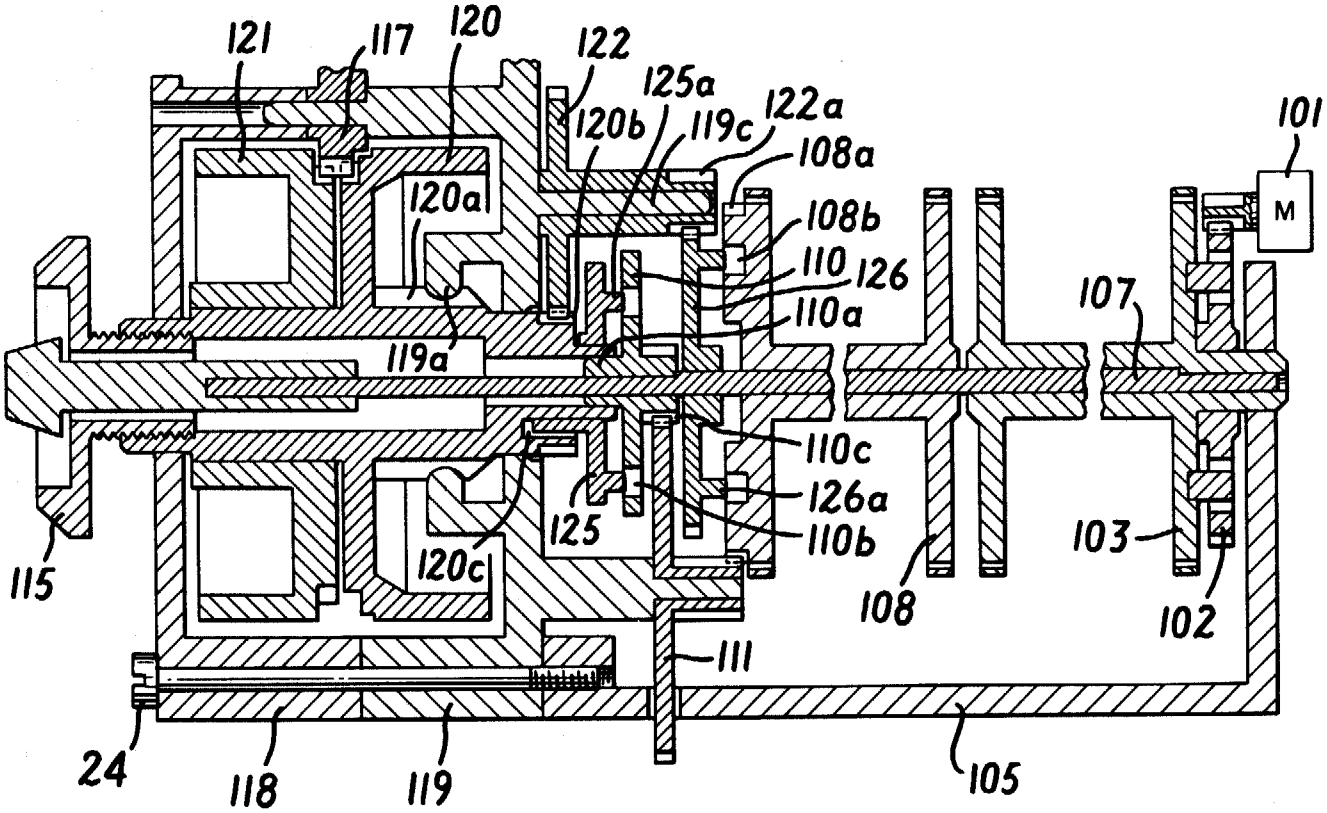
FIG. 3 is a main sectional view of the FIG. 2.

Now, a second embodiment shown in FIGS. 3 to 5 will be described.

An alarm signaling time indication mechanism will first be described. Designated at 101 is a driving motor, which is coupled with a minute hand wheel 102 for driving the same at a speed of one rotation per 60 minutes. The minute hand wheel 102 is coupled through a well-known ratchet mechanism to a minute leaf drum 103 for rotating the drum only in one direction. The minute leaf drum 103 is secured to a shaft 107. Its right hand end is journalled in a case 105, and it has 60 minute leaves.

Similar to the first embodiment, these minute leaves include first minute leaves 106*a* having no projection, second minute leaves 106*b* (not shown) each provided on the left hand edge with a projection 160, third minute leaves 106*c* each provided at the right hand edge with a projection 161 and fourth minute leaves 106*d* each provided at both the left and right hand edges with respective projections 160 and 161. Of these minute leaves, first minute leaves 106*a* are used as an upper side leaf when indicating "00" and "01" minutes past a given hour, third minute leaves 106*c* are used when indicating "02", "03" and "04" minutes past a given hour, first minute leaves 106*a* are again used when indicating "05" and "06" minutes past a given hour, and so on; two first minute leaves 106*a* and three third minute leaves 106*c* are combined and arranged as leaves for indicating up to "44" minutes past a given hour. Second minute leaves 106*b* are used when indicating "45" and "46" minutes past a given hour, fourth minute leaves 106*d* are used when indicating "47", "48" and "49" minutes past a given hour, and so on; two second minute leaves 106*b* and three fourth minute leaves 106*d* are combined and arranged for indicating up to "59" minutes past a given hour.

Designated at 108 is an hour leaf drum rotatably supported by the shaft 107, and it has 48 hour leaves 109. A second minute hand wheel 110 is secured to an intermediate portion of the shaft 107, and its boss 110*a* rotatably supports a minute indication drum 120. It has cam holes 110*b* and a pinion 110*c*. The pinion 110*c* is geared through an intermediate hour wheel 111 to an hour hand wheel 108*a* provided on the hour leaf drum 108. The hour hand wheel 108*a* is formed on its left side with cam holes 108*b*.

Designated at 113 is an hour leaf holding spring. When an hour leaf 109 is raised in an interlocked relation to the left hand projection 160 of the second and fourth minute leaves, the hour leaf 109 is held by the spring so that it will not be inverted even if it is detached from a second pawl 114*b* of a feed spring 114, and it is inverted simultaneously with the detachment of the fourth minute leaf 106*d* indicating "59" minutes past a given hour from a first pawl 114*a* of the feed spring, at which times "00" minute past the next hour is indicated and also the hour leaf 109 is released from the spring 113.

Now, an alarm signaling mechanism will be described. Designated at 115 is an alarm signaling time setting knob, which is coupled to a minute indication drum 120 having a 60-minute graduated scale of alarm signaling time, with time graduations provided at intervals of 5 minutes. The minute indication drum 120 is rotatably supported on one side by an intermediate member 119.

An hour indication drum 121, which is fed or advanced by one pitch with one rotation of the minute indication drum 120 through a carry gear 117, is rotatably supported on a central boss of the minute indication drum 120.

The minute indication drum 120 is provided in its intermediate portion with a click gear 120*a*, which engages with a click spring 119*a* projecting from the intermediate member 119 and provides a click stop action at an interval of, for instance, five minutes when the knob 115 is rotated. It is also provided adjacent to its right hand end with grooves 120*c* and ribs 120*b* between these grooves, as shown in FIG. 5, and a minute detection member 125 is coupled to the minute indication drum 120 such that it is not rotatable but movable in the axial direction with respect to the minute indication drum.

The minute indication member 125 has cams 125*a*, which can be received in the afore-mentioned cam holes 110*b* in the second minute hand wheel. The minute indication drum 120 is further provided adjacent to its right hand end with a pinion 120*b* which is meshed with an intermediate wheel 122, which is in turn guided for rotation by a boss 119*a*. The intermediate wheel 122 has a pinion 122*a* which is rotatable with the shaft 7 and meshed with the gear of an hour detection member 126, which is movable relative to the shaft 107.

The hour detection member 126 has cams 126*a*, which can be received in the afore-mentioned cam holes 108*b* in the hour drum.

Now, an alarm signaling time detecting mechanism shown in FIG. 4 will be described. Designated at 134 is a first detecting lever, which is rotatable about a pin 132 and has first and second arms 134*a* and 134*b* respectively adapted to cooperate with the afore-mentioned minute and four detection members 125 and 126 and also a pin 134c to be described later. When the preset alarm signaling time is not reached, the second arm 134b of the first detecting lever is in contact with the hour detection member 126, but the first arm 134a is spaced apart from the detection member 125 by an amount corresponding to the difference of the cam height as mentioned before. Designated at 135 is a second detecting lever, which is rotatable about a pin 136 and has a first cam 135a adapted to cooperate with the right hand projections of the third and fourth minute leaves 106c and 106d. Its other end is provided with a groove 135b in engagement with the pin 134c projecting from the first detecting lever. The first arm of the second detecting lever is provided in an intermediate portion with a projection 135c, which is adapted to cooperate with a first switch $SW_1$ to be described later. A second switch $SW_2$ is a so-called alarm stopping switch, and it is closed when the user wants to use a buzzer B. The switches $SW_1$ and $SW_2$ and buzzer B are connected in series across a power supply E.

The operation of the above construction will now be described. When the alarm signaling device is wanted to be used, the second switch $SW_2$ is first closed, and then the desired time is set by turning the knob 115 while watching the figures inscribed in the minute and hour indication drums 120 and 121. With the setting of the alarm signaling time the phases of the cams 125a and 126a of the minute and hour indication members 125 and 126 are determined. When the clock is left in this state, the motor M rotates the minute hand wheel 102, minute leaf drum 103 and second minute hand wheel 110 and also rotates the hour leaf drum 108 through the intermediate hour wheel 111.

As time advances the cam holes 108b of the hour leaf drum 108 and the cams 126a of the hour detection member 126 first come into coincidence with one another, so that the hour detection member 126 is now capable of being moved in the rightward direction by the force of the first switch $SW_1$ through the first detecting lever 134.

At this time, the phases of the cam 125a of the minute detection member and the hole 110b of the second minute hand wheel are not in coincidence with each other yet, so that the first arm 134a of the first detecting lever 134 strikes the minute detection member 125 and is stopped. At this time, the first arm 135a of the second detecting lever is still slightly spaced from the projection 161 of the minute leaf, so that the first switch $SW_1$ remains open. With further rotation of the hour hand wheel the cams 125a of the minute detection member 125 eventually come into coincidence in phase with the cam holes 110b of the second minute hand wheel 110. As a result, the minute detection member 125 is capable of being moved rightwards. Thus, the first and second detecting levers 134 and 135 are slightly rotated, and consequently the first arm 135a of the second detecting lever is rendered capable of cooperation with the minute leaf. At this time, however, the first arm 135a of the second detecting lever cooperates with the right hand projection of a fourth minute leaf 106c or 106d, so that no further rotation is obtained as shown in FIG. 4. The second switch $SW_2$ remains closed.

Figure 4:
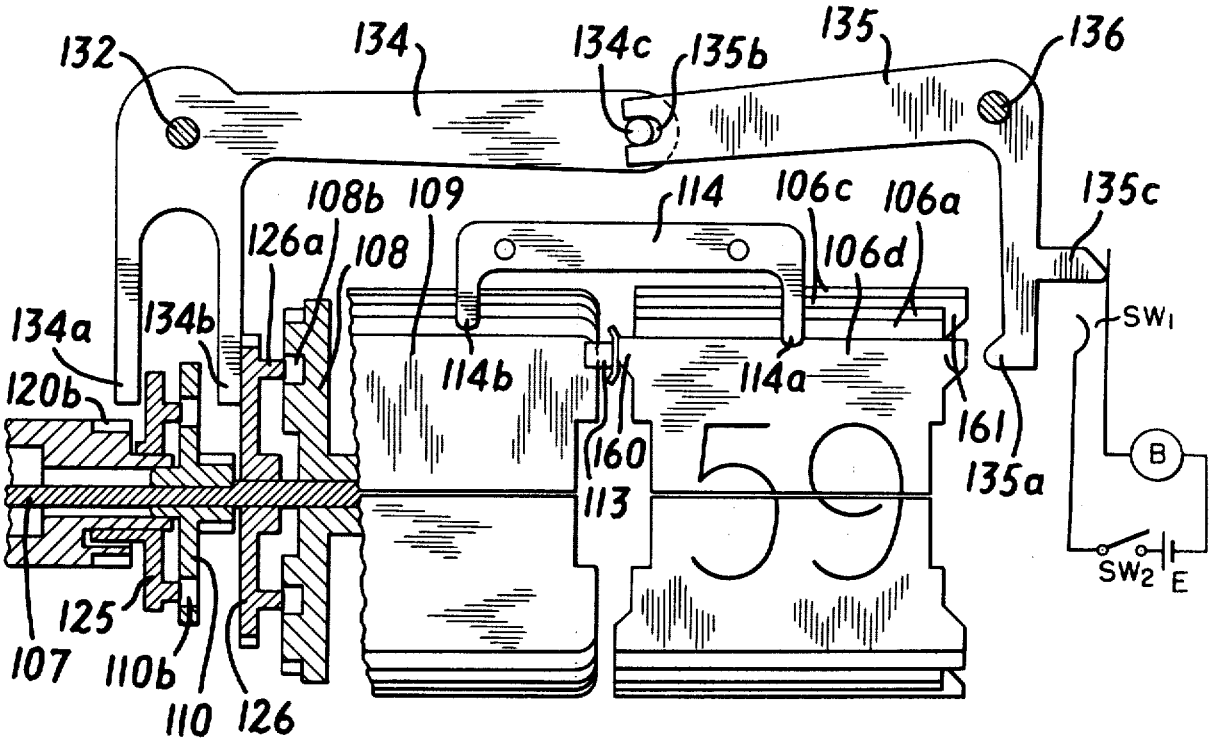
FIGS. 4, 5*a* and 5*b* are sectional views of the FIG. 3.
Figure 5A:
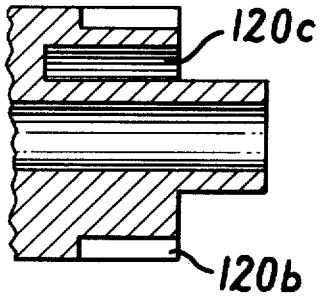
Figure 5B:
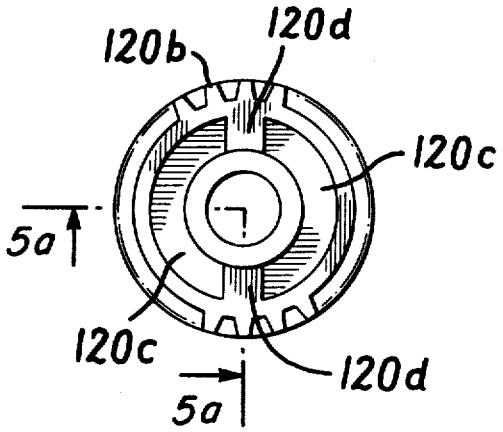

When the leaf indicating "59" minutes past a given hour, as shown in FIG. 4 is inverted to "00", there is no longer any projection restricting the second detecting lever. As a result, the first and second detecting levers are rotated by the force of the first switch $SW_1$ to close the first switch $SW_1$, thereby the buzzer B is operated. At this time, the operation of the buzzer B can be stopped by opening the second switch $SW_2$.

If the buzzer B is left sounding without taking the measure of stopping it, after a lapse of a couple of minutes from the triggering of the buzzer B the second detecting lever is raised again by the third minute leaf 106c, and as a result the associated first switch $SW_1$ is opened to stop the buzzer B once. When the time has further elapsed until "05" minutes past the given hour is indicated, the projection 161 is displaced to release the second detecting lever 135 thus causing clockwise rotation of the second detecting lever to close the first switch $SW_1$ and cause the buzzer B to sound again. In this way, if the measure of stopping the buzzer sound is not taken, the buzzer B is repeatedly caused to sound for every five minutes until the cams 125a of the minute detection member escape from the cam holes 110b of the second minute hand wheel.

As has been described in the foregoing, the leaf detection member adapted to cooperate with the projection 161 of the minute leaves is not in contact with the leaf not only when the alarm device is out of use, but also when the device is used, unless a close proximity of the alarm signaling time is reached, so that it does not always constitute a load of the motor and also a detecting mechanism of high reliability can be obtained.

What is claimed is:

1. In an alarm time detecting device for a leaf type digital clock which includes an hour time wheel; minute leaves successively positioned for viewing to show the passage of minutes, wherein certain ones of said minute leaves have a respective projection extending therefrom and the remaining ones of said minute leaves lack a projection corresponding to said respective projections of said certain minute leaves; a first detecting member angularly positionable relative to said hour time wheel for engaging said hour time wheel at an alarm time corresponding to the angular position of said first detecting member and for producing a mechanical signal when said hour time wheel is engaged; a first detecting lever positionable by said first detecting member; a second detecting lever positionable by said first detecting lever and positionable to be unaffected by setting of the alarm time and cooperative with said minute leaves for producing a second mechanism signal; and an alarm device actuated when both the first and the second mechanical signals occur; the improvement comprising: said second detecting lever dimensioned to be positioned by said first detecting lever so as to be clear of said minute leaf projections before said first detecting member produces the first mechanical signal and for moving to be engaged by said minute leaf projections after said first detecting member has engaged said hour time wheel and produced the first mechanical signal; and said second detecting lever being released by said minute leaf projections as said minute leaves are successively positioned for viewing to release said second detecting lever for further movement which constitutes said second mechanical signal.

2. In an alarm time detecting device according to claim 1; a second detecting member; and wherein said first detecting lever has two arms, one of said detecting lever arms cooperating with said first detecting member and the second of said detecting lever arms cooperating with said second detecting member.

3. In an alarm time detecting device according to claim 1; a minute time wheel and a second detecting member movable when said minute time wheel rotates into coincidence in phase with said second detecting member; said first detecting lever having an arm and first and second contacting portions on said arm positioned to cooperate with said respective first and second detecting members for moving said second detecting lever to be engaged by said minute leaf projections when said hour and minute time wheels are respectively in phase with said first and second detecting members, said second contacting portion being positioned to cooperate with said second detecting member after the actuation of said first detecting member, and said second detecting lever being released for engaging a projection of one of said certain minute leaves in response to the actuation of said second detecting member.

* * * * *